US006443751B1

(12) United States Patent
Pan

(10) Patent No.: US 6,443,751 B1
(45) Date of Patent: Sep. 3, 2002

(54) INPUT/OUTPUT CONNECTOR

(75) Inventor: Long-Jyh Pan, Taipei Hsien (TW)

(73) Assignee: Acer Peripherals, Inc., Taoyuan (TW)

( * ) Notice: Subject to any disclaimer, the term of this patent is extended or adjusted under 35 U.S.C. 154(b) by 0 days.

(21) Appl. No.: 09/411,519

(22) Filed: Oct. 4, 1999

(30) Foreign Application Priority Data

Nov. 13, 1998 (TW) ..... 87218861 U

(51) Int. Cl.[7] ..... H01R 4/50
(52) U.S. Cl. ..... 439/342; 439/345
(58) Field of Search ..... 439/527, 574, 439/575, 352, 345, 609, 610, 342, 346, 337, 376, 378

(56) References Cited

U.S. PATENT DOCUMENTS 3,066,276 A * 11/1962 Hubbell et al. ..... 439/337
3,885,850 A * 5/1975 Witte et al. ..... 439/346
4,074,341 A * 2/1978 Niederöst et al. ..... 439/345
4,388,010 A * 6/1983 Mott et al. ..... 439/342
4,629,266 A * 12/1986 Viselli ..... 439/609
4,773,878 A * 9/1988 Hansell, III ..... 439/610
5,295,861 A * 3/1994 Peretick et al. ..... 439/527
5,415,568 A * 5/1995 Kinoshita ..... 439/610
5,445,534 A * 8/1995 Ishizuka et al. ..... 439/352

* cited by examiner

*Primary Examiner*—Hien Vu
(74) *Attorney, Agent, or Firm*—Ladas & Parry

(57) ABSTRACT

An input/output connector adapted for a mobile electronic device. The input/output connector includes a first connecting member, a first terminal, at least one second terminal and a second connecting member. The first connecting member is disposed inside the mobile electronic device and is provided with a first terminal hole and at least one second terminal hole. An engaging block is positioned inside the first terminal hole. The first terminal is provided with an elastic arm for pressing toward the engaging block contiguously. The second connecting member is provided with a head portion and an engaging slot. When the head portion is inserted into the first terminal hole, the engaging slot engages with the engaging block by the elastic force of the elastic arm. According to the input/output connector of the present invention, the plug is not easily worn out. Furthermore, the input/output connector of the present invention occupies less space.

21 Claims, 10 Drawing Sheets

INPUT/OUTPUT CONNECTOR

BACKGROUND OF THE INVENTION

1. Field of the Invention

The present invention relates to an input/output connector, and in particular to an input/output connector adapted for a mobile electronic device,such as a cellular phone.

2. Description of Prior Art

An input/output connector can transmit signals into and out of a mobile electronic device. Referring to a cellular phone shown in FIG. 1, numeral 1 represents an upper shell of the cellular phone, numeral 2 represents a lower shell that detachably engages with the upper shell 1, and numeral 3 represents a printed circuit board disposed in the lower shell 2. A connector 4 is usually mounted at the bottom of the lower shell 2 and is electrically connected to the printed circuit board 3. Numeral 5 represents a plug, which can be inserted into the connector 4 so as to transmit external signals into the cellular phone. Also, signals of the cellular phone can be transmitted out of the cellular phone by means of the connector 4 and the plug 5.

FIG. 2*a* is a schematic view of a conventional input/output connector. The connector 4 is provided with an engaging hole 41, two engaging blocks 42 and two pads 43. In fact, the engaging blocks 42, located at the end portion of the engaging hole 41, are close to the inserting plug 5. The plug 5 is provided with an engaging portion 51 and two contacts 52. The engaging portion 51 is made of elastic material. The connector 4 can engage with the plug 5 by means of the engagement between the engaging portion 51 and the engaging blocks 42 inside the engaging hole 41.

When the engaging portion 51 is abutted against the engaging blocks 42, an external force toward the engaging hole 41 is applied to the engaging portion 51 so that the engaging portion 51 deforms and enters the engaging hole 41 through the engaging blocks 42, as shown in FIG. 2*b*. Therefore, the connector 4 engages with the plug 5, in the meanwhile the pads 43 are in contact with the contacts 52 of the plug 5 so as to transmit power or signals. When the external force toward the outside of the engaging hole 41 is applied to the plug 5, the engaging portion 51 deforms and disengages with the engaging blocks 42 so that the plug 5 is pulled out of the connector 4.

However, the input/output connector as shown in FIG. 2*a* and 2*b* still has some defects. The following are the defects of the input/output connector as shown in FIG. 2*a* and 2*b*.

(1) Since the connector engages with the plug by the elastic deformation of the engaging portion, the elastic force of the engaging portion may be fatigued after being used over a long period of time. Accordingly, the quality of the engagement between the connector and the plug can not be assured.

(2) Because the plug can not securely engage with the connector, the problem that the plug accidentally escapes from the connector often occurs.

The present invention focuses on the improvement of the connector 4 and engaging portion 51 of the plug 5. In the present invention, the contacts 52 are the same as the prior art shown in FIG. 1, FIG. 2*a* and FIG. 2*b* and thus will not be further described in the following description.

SUMMARY OF THE INVENTION

The object of the present invention is to solve the above-mentioned problems and provide an input/output connector adapted for a mobile electronic device comprising a first connecting member, a first terminal, at least one second terminal and a second connecting member. The first connecting member is disposed inside the mobile electronic device and provided with a first terminal hole and at least one second terminal hole. An engaging block is formed inside the first terminal hole. The first terminal is disposed inside the first terminal hole and is provided with an elastic arm for pressing toward the engaging block. The second connecting member is provided with a head portion and an engaging slot. When the head portion is inserted into the first terminal hole, the engaging slot engages with the engaging block by means of the elastic force of the elastic arm.

Specifically, the first connecting member is provided with an opening corresponding to the elastic arm of the first terminal; thereby, the elastic arm is located in the opening when the head portion is passing over the engaging block.

Specifically, the input/output connector further comprises a third terminal disposed on the plug. Thus, when the head portion is inserted into the first terminal hole, the third terminal is in contact with the elastic arm.

Specifically, the first connecting member is provided with at least one hole and the first terminal is provided with at least one block received in the hole.

Specifically, the elastic arm is provided with a convex portion.

BRIEF DESCRIPTION OF THE DRAWINGS

The objects, features and advantages of the present invention can be more fully understood by reading the subsequent detailed description and examples with reference made to the accompanying drawings, wherein.

DESCRIPTION OF THE PREFERRED EMBODIMENT

Figure 1:
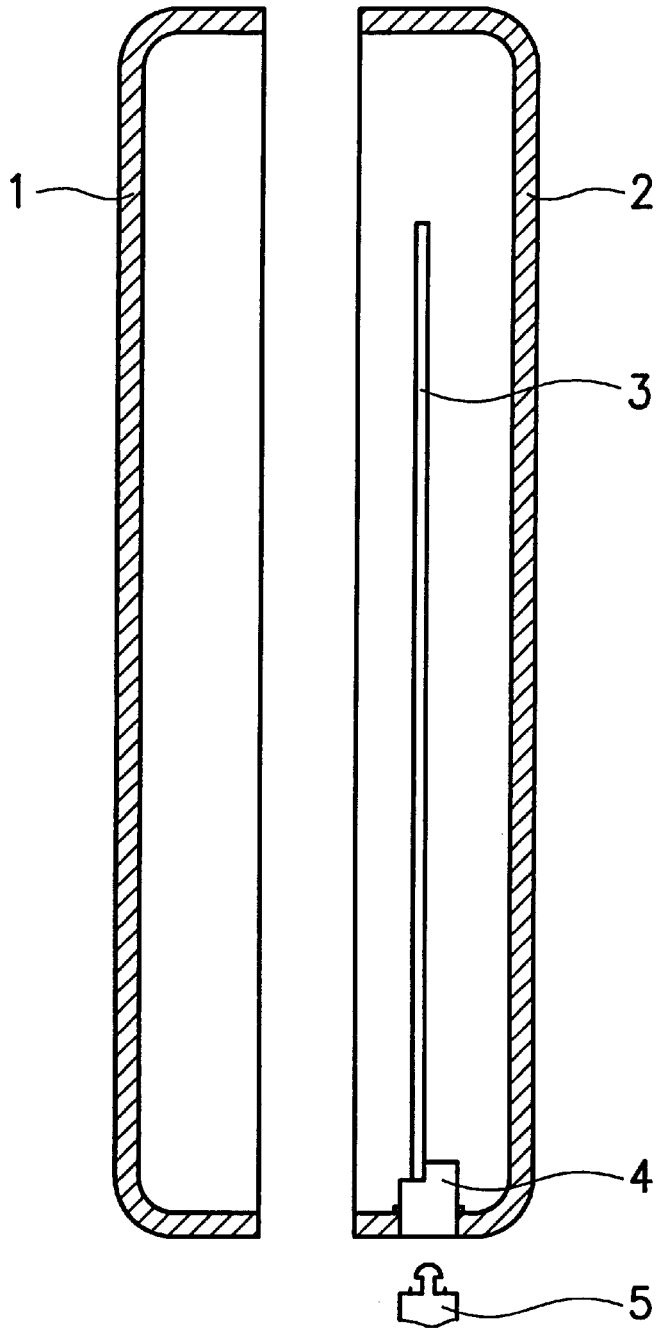
FIG. 1 (PRIOR ART)
FIG. 1 is a schematic diagram of a cellular phone.
Figure 2A:
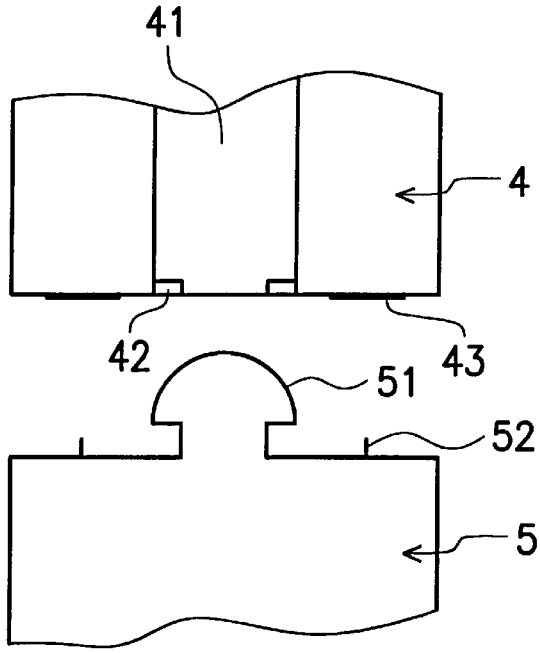
FIG. 2a (PRIOR ART)
FIG. 2*a* is a schematic diagram of a conventional input/output connector, wherein a plug is not engaged with a connector.
Figure 2B:
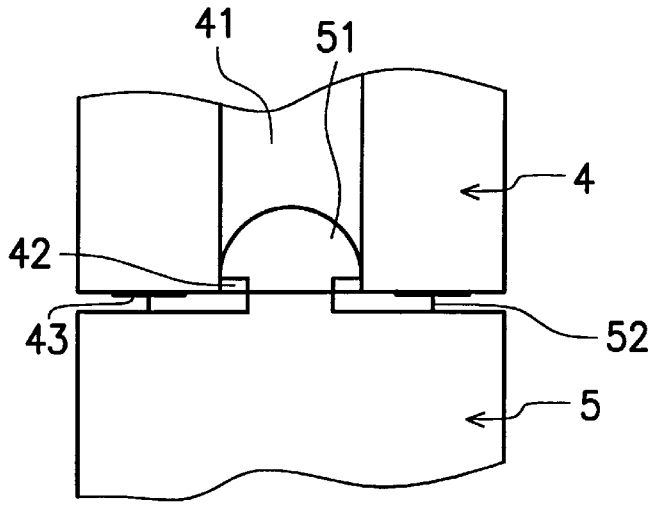
FIG. 2b (PRIOR ART)
FIG. 2*b* is a schematic diagram of the conventional input/output connector, wherein the plug is engaged with the connector.
Figure 3A:
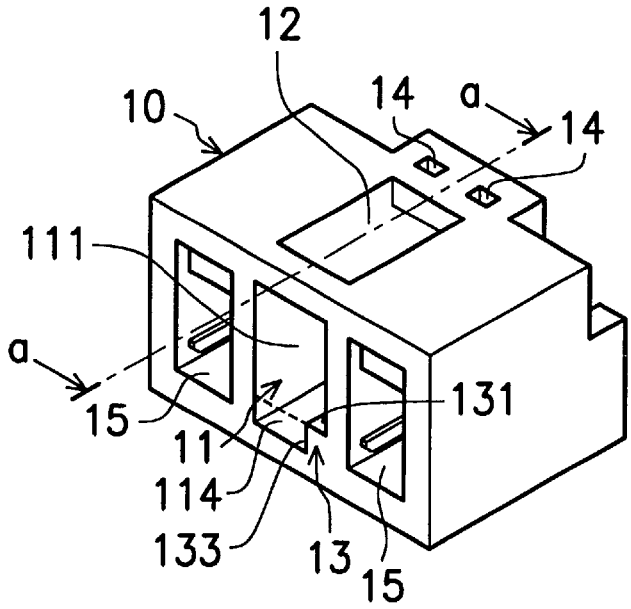
FIG. 3*a* is a three-dimensional diagram of a first connecting member of the present invention.

The connector of the present invention is described referring to FIGS. 3*a,* 3*b,* 4*a,* 4*b,* 5*a,* 5*b,* 5*c,* 5*d* and 5*e.*

The connector of the present invention consists of a first connecting member, a first terminal and two second terminals. Since the shape and disposition of the second terminals are the same as in the conventional art, the description of the second terminals is omitted.

Figure 3B:
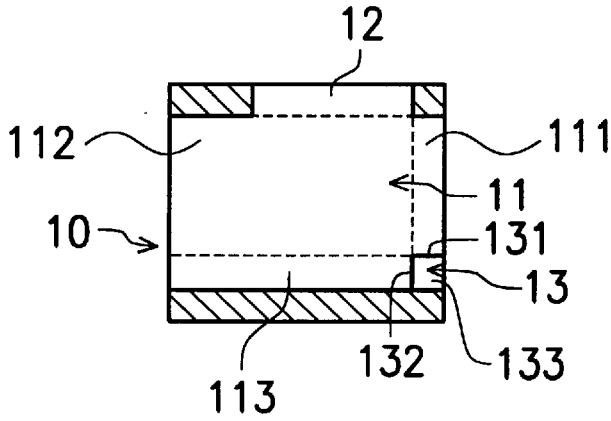
FIG. 3*b* is a sectional diagram along line a—a in FIG. 3*a;*

FIGS. 3*a* and 3*b* show the first connecting member of the present invention. Please refer to FIG. 3*a.* The first connecting member 10 is substantially rectangular in shape and is provided with a first terminal hole 11 and two second terminal holes 15. The first connecting member 10 is also provided with an opening 12 and two holes 14 at the upper portion thereof. FIG. 3*b* is the sectional diagram along line a—a in FIG. 3*a.* As can be seen in FIG. 3*b,* an engaging block 13 is located at one side of the front end of the first terminal hole 11. The engaging block 13 has a first surface 131, a second surface 132, and a third surface 133.

It is noted that the holes 14 make the engagement between the first terminal (described later) and the first terminal hole 11 more stable, and the engaging block 13 makes the engagement between the first terminal hole 11 and a second connecting member (described later) more stable. In addition, after the first terminal is positioned inside the first terminal hole 11, it can sway upwards and downwards in the opening 12.

The first terminal hole 11 further comprises a receiving space 111, an internal cavity 112, an engaging space 113, and a communicating channel 114. The engaging block 13 is located at one side of the front end of the first terminal hole 11 so that the engagement between the first terminal hole 11 and the second connecting member is directive. The communicating channel 114 is formed at the other side of the front end of the first terminal hole 11. As a result, the improper assembly between the first terminal hole 11 and the second connecting member will not occur.

Figure 4A:
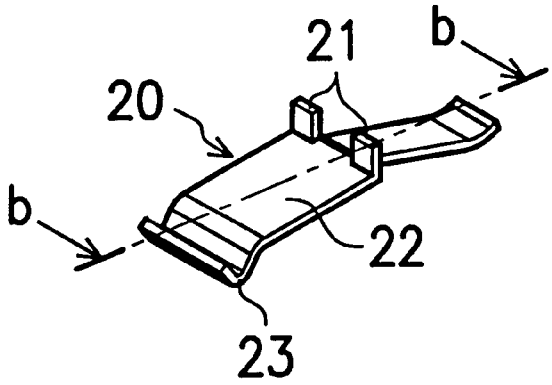
FIG. 4*a* is a three-dimensional diagram of a first terminal of the present invention.
Figure 4B:
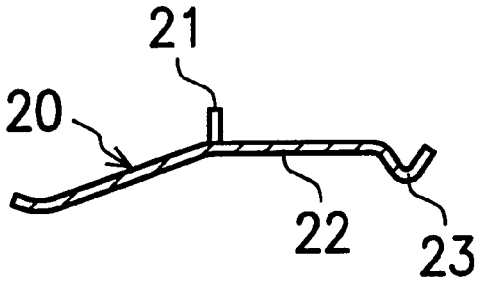
FIG. 4*b* is a sectional diagram along line b—b in FIG. 4*a;*

FIGS. 4*a* and 4*b* show the first terminal of the present invention. The first terminal 20 is substantially a long narrow strip, and is provided with two blocks 21 at the upper portion thereof. When the first terminal 20 engages with the first terminal hole 11, the two blocks 21 also engage with the holes 14 respectively so as to make the engagement between the first terminal 20 and the first terminal hole 11 more stable.

Furthermore, the first terminal 20 is provided with an elastic arm 22. Accordingly, when the second connecting member enters the first terminal hole 11, the elastic arm 22 sways upwards and downwards based on the movement of the second connecting member so as to make the second connecting member engage with the first terminal hole 11.

A convex portion 23 is formed at one end of the elastic arm 22 in contact with the second connecting member described later. The provision of the convex portion 23 makes the contact between the first terminal 20 and the second connecting member more stable.

Figure 5A:
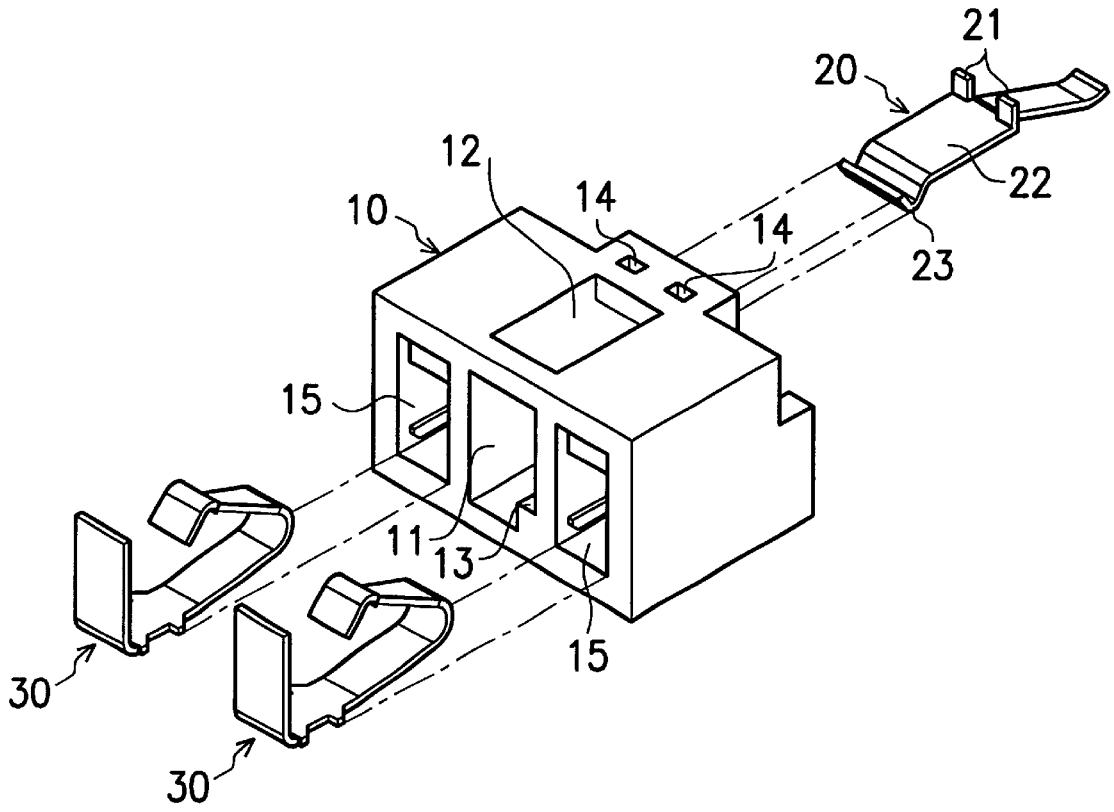
FIG. 5*a* is an exploded view of a connector of the present invention.
Figure 5B:
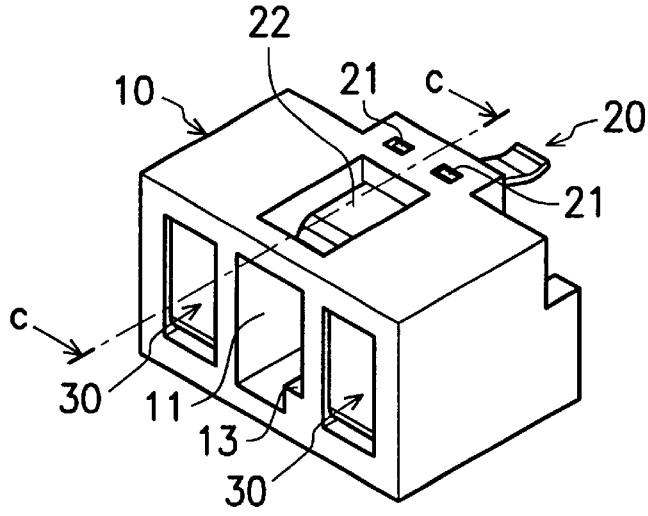
FIG. 5*b* is a three-dimensional diagram of the connector of the present invention.

FIGS. 5*a,* 5*b,* 5*c,* 5*d,* and 5*e* show the connector of the present invention. The connector of the this embodiment consists of a first connecting member 10, a first terminal 20 and two second terminals 30, 30. When the first terminal 20 engages with the first terminal hole 11, the blocks 21 of the first terminal 20 engage with the holes 14 of the first connecting member 10 while the convex portion 23 of the first terminal 20 is located beneath the opening 12 of the first connecting member 10, as shown in FIG. 5*d.*

Figure 5C:
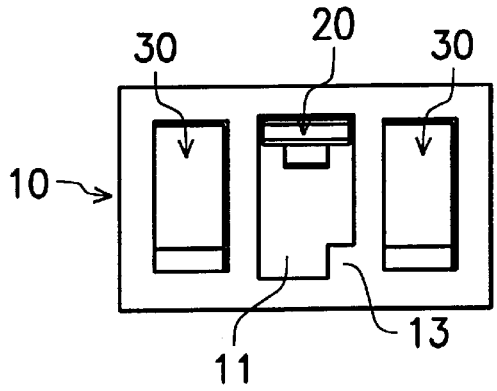
FIG. 5*c* is a front view of the connector of the present invention.
Figure 5D:
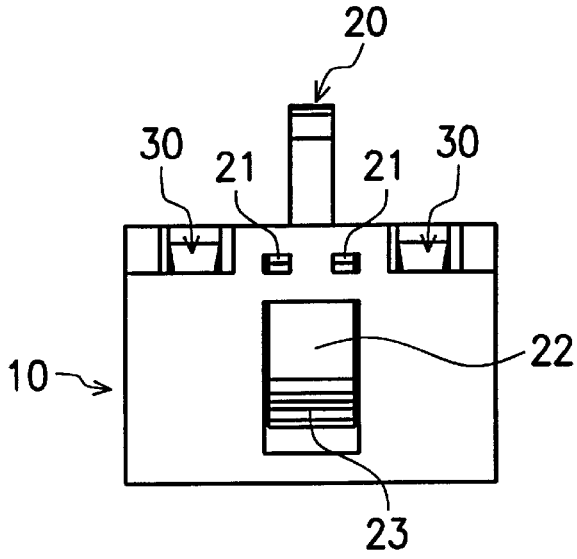
FIG. 5*d* is a top view of the connector of the present invention.
Figure 5E:
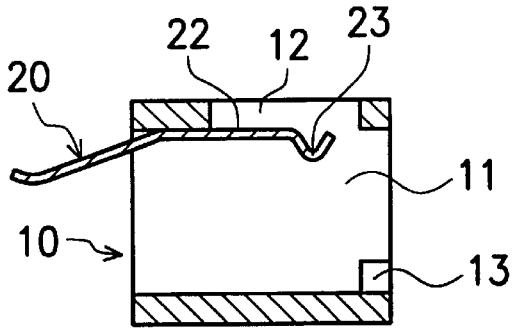
FIG. 5*e* is a sectional diagram along line c—c in FIG. 5*b;*

After the first terminal 20 and the second terminals 30, 30 are positioned inside the first connecting member 10, the front ends of the first terminal 20 and the second terminals 30, 30 (as shown in FIG. 5*c*) can communicate with the outside of the connector while the rear ends of the first terminal 20 and the second terminals 30, 30 (as shown in the upper part of FIG. 5*d*) can communicate with the internal printed circuit board. As a result, the connector can communicate with the outside of the connector and the internal printed circuit board.

Furthermore, the first terminal 20 and the second terminals 30, 30 are made of electricity-conductive material, such as metal.

Figure 6A:
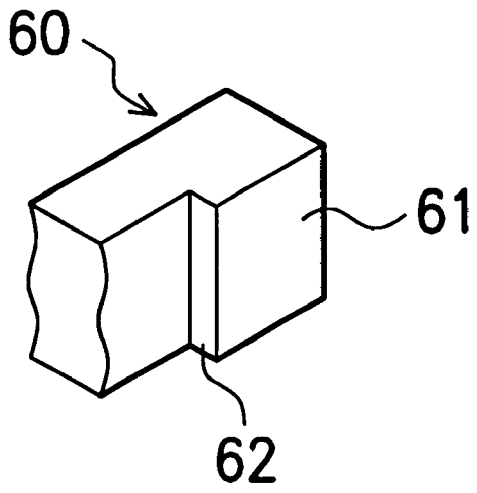
FIG. 6*a* is a three-dimensional diagram of a second connecting member of the present invention.
Figure 6B:
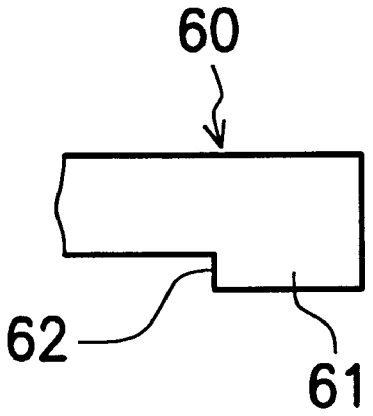
FIG. 6*b* is a top view of the second connecting member of the present invention.

FIGS. 6*a* and 6*b* show the second connecting member of the present invention. The second connecting member 60 is substantially rectangular in shape, and is provided with a head portion 61 and a engaging slot 62. The head portion 61 is dimensioned to be insertable by the engaging space 113 of the first terminal hole 11. The engaging slot 62 is formed substantially close to an end of the second connecting member 60, is dimensioned for receiving the engaging block 13 of the first connecting member 10.

Figure 7:
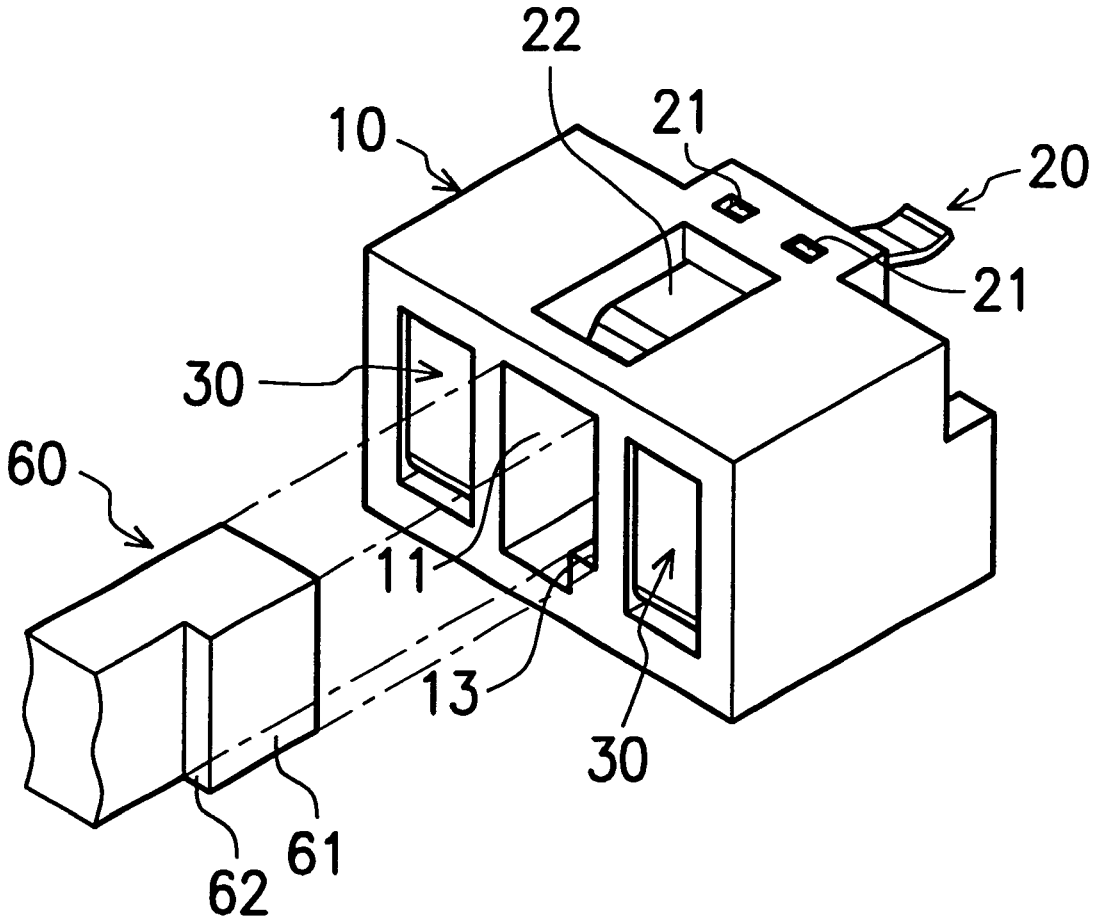
FIG. 7 is an exploded view of an input/output connector of the present invention.

FIG. 7 is an exploded view of the input/output connector of the present invention. The connection between the connector and the second connecting member can be more clearly understood by this figure.

Figure 8A:
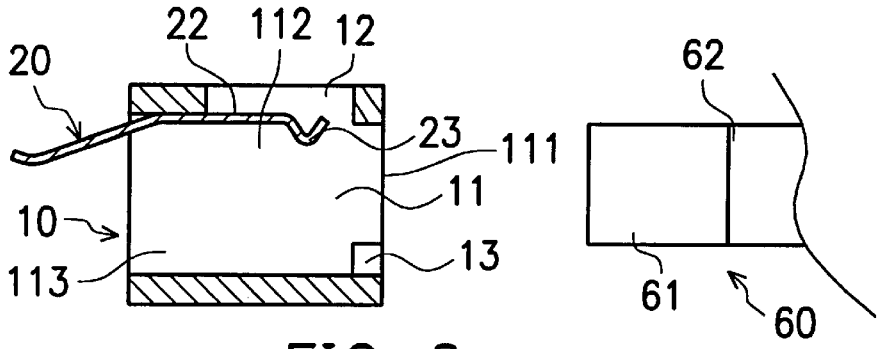
FIGS. 8*a,* 8*b,* 8*c,* and 8*d* are schematic diagrams showing the engagement procedures of the input/output connector of the present invention.
Figure 8B:
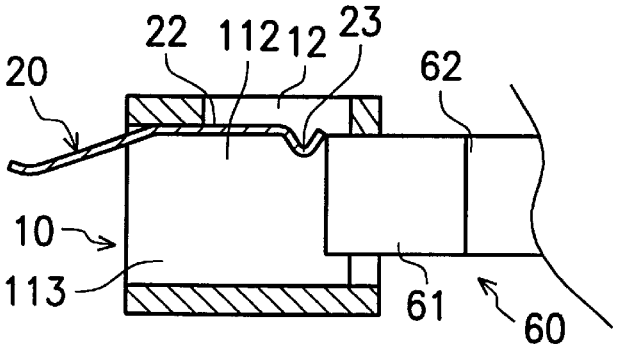
Figure 8C:
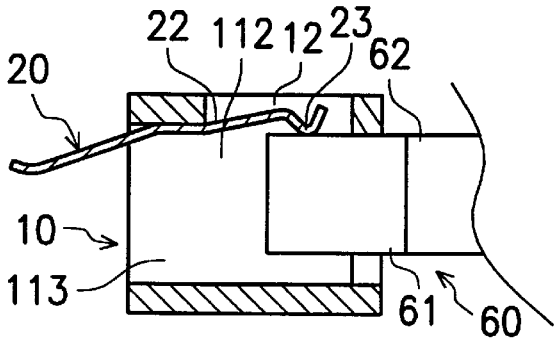
Figure 8D:
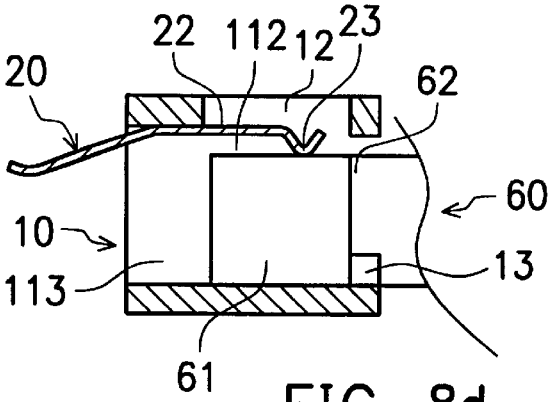

FIGS. 8*a,* 8*b,* 8*c,* and 8*d* are schematic diagrams showing the engagement procedures of the input/output connector of the present invention. In FIG. 8*a,* the relative position between the engaging block 13 of the first connecting member 10 and the head portion 61 of the second connecting member 60 can be seen. In FIG. 8*b,* the front end of the head portion 61 passes through the receiving space 111, and abuts against the front end of the convex portion 23 of the first terminal 20. Then, the head portion 61 moves along the lower edge of the convex portion 23 and enters the internal cavity 112 of the first terminal hole 11, while the convex portion 23 is pushed upwards into the opening 12, as shown in FIG. 8*c.* After the head portion 61 passes through the receiving space 111 and passes over the engaging block 13 completely, the elastic arm 22 pushes the head portion 61 downwards by the elastic force itself so that the head portion 61 enters the engaging space 113 and the engaging slot 62 engages with the engaging block 13, as shown in FIG. 8*d.* Therefore, the connection between the connector and the second connecting member 60 is completed.

When the head portion 61 inserted into the connector is desired to be pulled out of the connector, the second connecting member 60 is subjected to the external force toward the outside of the connector. The disengagement between the connector and the second connecting member 60 is processed in a procedure as shown from FIG. 8*d,* FIG. 8*c,* FIG. 8*b* to FIG. 8*a.*

Figure 9A:
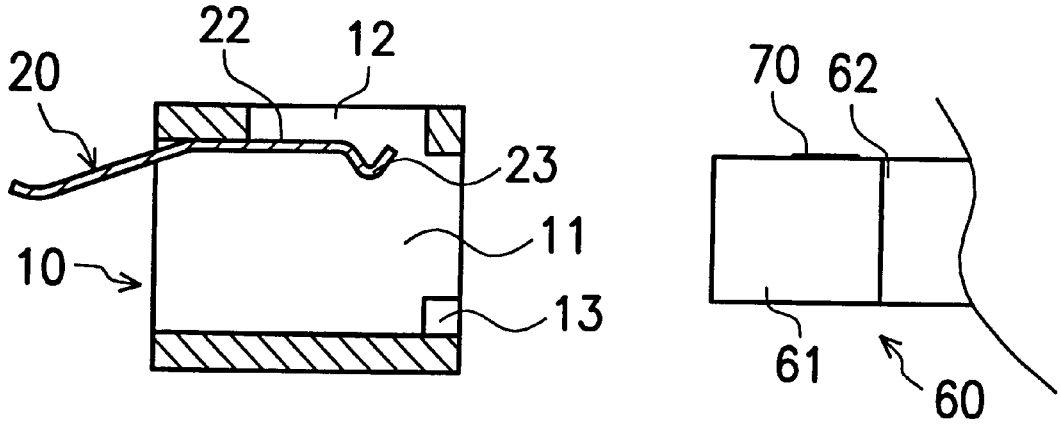
FIGS. 9*a* and 9*b* are schematic diagrams showing the engagement between the connector and the head portion with a third terminal.
Figure 9B:
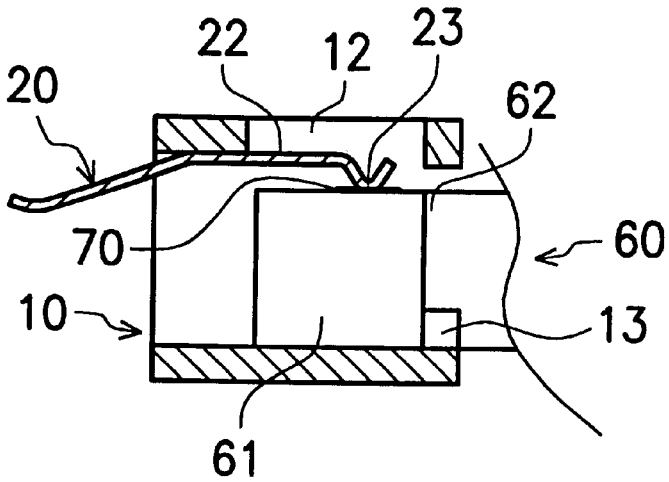

Furthermore, a third terminal 70 can be provided on the surface of the head portion 61 facing the first terminal 20, as shown in FIG. 9*a.* Thus, after the head portion 61 enters the first terminal hole 11 as shown in FIG. 9*b,* the contact between the first terminal 20 and the third terminal 70 forms another signal transmission path. Accordingly, it is possible to eliminate one or two second terminals.

Furthermore, the third terminal 70 is made of metal.

Although there are only two second terminals in the figures, however, there is no limit on the number of the second terminals in practical applications. Furthermore, the position of the first terminal hole is not required to be at the position between two second terminal holes.

The following are the advantages of the present invention:

(1)The plug (second connecting member) is not easily worn out and can remain functionable after frequent use.

(2)The structure of the plug is simplified; therefore, the plug can be used conveniently. Also, the plug will not be pulled out of the connector accidentally.

(3)Since the contact between the first terminal and the third terminal forms a signal transmission path, the number of second terminals can be reduced.

(4)The engaging block is positioned at a specific side of the first terminal hole so that the proper inserting direction of the plug can be assured when the plug engages with the connector. As a result, the position of the engaging block prevents the improper assembly of the user.

Although this invention has been described in its preferred embodiments, it is understood that the present disclosure of the preferred embodiments can be modified in the details of contraction. The scope of the invention should be determined by the appended claims and not by the specific examples given herein.

What is claimed is:

1. An electrical connector adapted for an electronic device, comprising:

a first connecting member disposed on the electronic device, including a first terminal hole and a rectangular engaging block positioned inside the first terminal hole;

an elastic arm disposed inside the first terminal hole; and a second connecting member having a head portion, the head portion having an engaging slot capable of engaging with the engaging block of the first connecting member, wherein when the head portion is inserted into the first terminal hole along a first direction, the elastic arm pushes the head portion in a second direction substantially perpendicular to the first direction such that the engaging slot engages with the engaging block to prevent the second connecting member from escaping and said engaging slot and engaging block have surfaces substantially parallel to said second direction and wherein the first connecting member has a through opening on a top wall thereof corresponding to the elastic arm such that the elastic arm is capable of moving into the opening when the head portion is inserted into the first terminal hole.

2. The electrical connector as claimed in claim 1, further comprising a third terminal disposed on the head portion, wherein the third terminal is in contact with the elastic arm when the head portion is inserted into the first terminal hole.

3. The electrical connector as claimed in claim 1, further comprising a third terminal disposed on the head portion, wherein the third terminal is in contact with the elastic arm when the head portion is inserted into the first terminal hole.

4. The electrical connector as claimed in claim 1, wherein the first connecting mender has at least one hole and the elastic arm has at least one block formed in the hole.

5. The electrical connector as claimed in claim 1, wherein the elastic arm is provided with a convex portion.

6. The electrical connector as claimed in claim 1, wherein the elastic arm and the third terminal are made of metal.

7. The electrical connector as claimed in claim 1, wherein the electronic device is a cellular phone.

8. The electrical connector as claimed in claim 1, wherein the head portion of the second connecting member is rectangular.

9. The electrical connector as claimed in claim 1, wherein the second connecting member is substantially rectangular in shape.

10. The electrical connector as claimed in claim 1, wherein the elastic arm is adapted to be removed from the first connecting member.

11. An electrical connector structure comprising:

a first connecting member including an internal cavity, a receiving space, an engaging space and an engaging block, the receiving space recessed from an outer surface of the first connecting member to communicate with the internal cavity, the engaging space recessed from a bottom surface of the internal cavity to expose a second surface of the engaging block;

a second connecting member having a rectangular head portion and an engaging slot, the engaging slot shaped for engaging with the engaging block, the head portion dimensioned to be insertable into the engaging space; and an elastic member disposed in the internal cavity for pressing the second member toward the engaging space, wherein when the head portion is disposed in the internal cavity and the engaging slot is positioned above the engaging block, the elastic member presses the second connecting member to make the head portion sliding along the second surface and then received by the engaging space, thereby to prevent the second connector from escaping and wherein the first connecting member has a through opening on a top wall thereof corresponding to the elastic member such that the elastic member is capable of moving into the opening when the head portion is inserted into the first terminal hole.

12. The electrical connector structure as claimed in claim 11, wherein the connector structure further comprises a communication channel formed between the engaging space and the outer surface of the first connecting member to expose a third surface of the engaging block, wherein the second connecting member simultaneously engages with the second surface and the third surface of the engaging block when the head portion is received by the engaging space.

13. The electrical connector structure as claimed in claim 11, wherein the engaging block is rectangular.

14. The electrical connector structure as claimed in claim 11, wherein the second connecting member is substantially rectangular in shape.

15. The electrical connector structure as claimed in claim 11, wherein the elastic member is adapted to be removed from the first connecting member.

16. An electrical connector adapted for an electronic device, comprising:

a first connecting member including a terminal hole and an engaging block, the terminal hole including a front end, a receiving space, an internal cavity, and an engaging-space, the engaging block being disposed at one side of the front end of the terminal hole and defining a communicating channel distinct from the receiving space at the other side of the front end;

a second connecting member receivable into the receiving space along a first direction, the second connecting member including a head portion and a connecting slot, the head portion dimensioned to be received in the engaging space, and the connecting slot dimensioned to receive the engaging block; and an elastic member disposed in the internal cavity for pressing the head portion in a second direction substantially perpendicular to the first direction and towards the engaging space when the head portion is inserted into the internal cavity, such that a portion of the second connecting member is received by the communicating channel, the head portion is received by the engaging space, and the connecting slot is engaged with engaging block to engage the second connecting member to the first connecting member wherein the first connecting member has a through opening on a top wall thereof corresponding to the elastic member such that the elastic member is capable of moving into the opening when the head portion is inserted into the first terminal hole.

17. The electrical connector as claimed in claim 16, further comprising a third terminal disposed on the head portion, wherein the third terminal is in contact with the elastic member when the head portion is inserted into the first terminal hole.

18. The electrical connector as claimed in claim 16, wherein the first connecting member has at least one hole and the elastic member has at least one block positioned in the hole.

19. The electrical connector as claimed in claim 16, wherein the elastic member is provided with a convex arm.

20. The electrical connector as claimed in claim 16, wherein the elastic member and the third terminal are made of metal.

21. The electrical connector as claimed in claim 16, wherein the electronic device is a cellular phone.

* * * * *